United States Patent [19]

Figg et al.

[11] 4,362,103

[45] Dec. 7, 1982

[54] INK PAD ASSEMBLY

[75] Inventors: Anthony V. J. Figg, Kirby Cross; Brian Nicholson, St. Osyth, both of England

[73] Assignee: Norcros Investments Limited, Reading, England

[21] Appl. No.: 241,676

[22] Filed: Mar. 9, 1981

[30] Foreign Application Priority Data

Mar. 11, 1980 [GB] United Kingdom ..... 8008125

[51] Int. Cl.[3] ..... B41F 31/26

[52] U.S. Cl. ..... 101/348; 101/324

[58] Field of Search ..... 101/348, 349, 324, 327

[56] References Cited

U.S. PATENT DOCUMENTS 3,622,059 11/1971 Savela ..... 101/348 X 4,207,818 6/1980 Hamisch, Jr. ..... 101/348

4,301,729 11/1981 Fujita ..... 101/348 X

OTHER PUBLICATIONS

Kirsch, "Snap-on Idler Roll", *Xerox Disclosure Journal*, vol. 5, No. 1, Jan./Feb. 1980.

*Primary Examiner*—Clifford D. Crowder

*Attorney, Agent, or Firm*—Leydig, Voit, Osann, Mayer & Holt, Ltd.

[57] ABSTRACT

An inking pad assembly includes a support spindle on which a cylindrical inking pad is mounted. The inking pad is mounted on a sleeve which is a free rotating fit on the spindle apart from a central location where the clearance is relatively small. This central location enables limited pivotal movement of the ink pad about axes transverse to the axes of the rotation of the pad.

The ink pad assembly has a knob by which it can be locked into a wall of apparatus in which the pad is incorporated.

8 Claims, 1 Drawing Figure

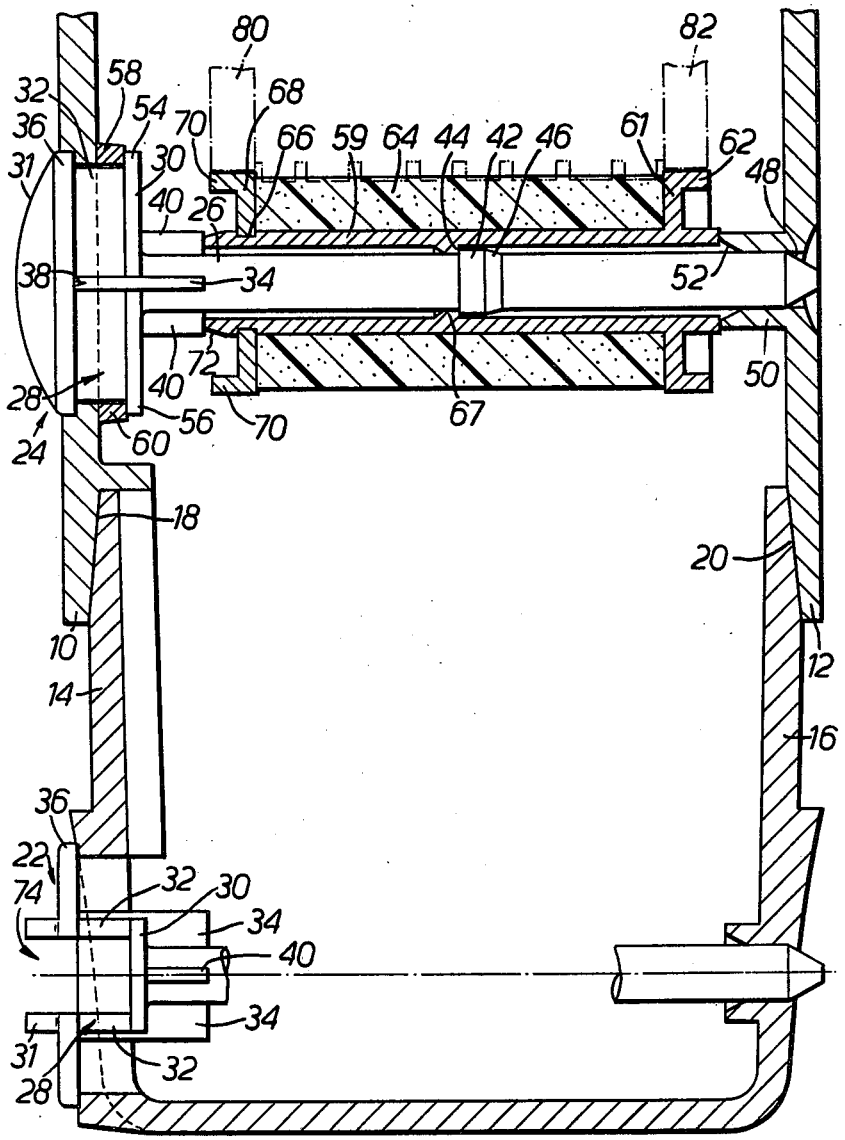
80
82
58
32
54
68
36
70
66
59
64
44
42
46
61
62
31
30
48
40
26
38
34
52
72
40
50
28
56
70
67
24
60
18
20
10
12
14
16
36
22
32
30
74
34
40
34
31
32
28

INK PAD ASSEMBLY

BACKGROUND OF THE INVENTION

1. Field of the Invention

This invention relates to an inking pad assembly for use, for example, in hand-held printing apparatus.

2. Description of the Prior Art

Small-size printing apparatus, such as hand-held label applicators including a print head, are assembled from a large number of parts each of which will have dimensional tolerances. Generally such tolerances do not adversely affect the satisfactory operation of an assembled apparatus, but it is inevitable that a percentage of the assembled apparatus will have a cumulative tolerance which results in slight misalignment of one part in relation to another. Such a cumulative tolerance error can arise between operative print facets or clichees of a print head and an ink-applying pad with the result that some clichees are inked more heavily than others and in extreme cases some clichees may not be inked at all. Such a situation is clearly undesirable since apparently incorrectly printed labels are liable to give rise to costly errors where prices or stock-coding are involved. If certain printed characters are too weak, loss of customer goodwill may arise.

Label applicators of the manually-operable kind are not large enough to accommodate ink reservoirs and it is, therefore, important that ink pads can readily be exchanged and that this exchange will not result in the operators' hands or clothes becoming stained with printing ink. Clearly an ink pad should satisfy the requirement that exchange can be effected without risk of such staining.

One object of the present invention is to provide an ink pad assembly which can be incorporated in a printing apparatus and will continue to ink print facets evenly, irrespective of misalignment between such facets and the pad.

It is another object of the present invention to provide an ink pad assembly which can be readily replaced in a printing apparatus which small risk of soiling an operators' hands or clothes.

SUMMARY OF THE INVENTION

According to the present invention there is provided an inking pad assembly comprising an inking pad roller rotatably about its longitudinal axis, and means mounting the roller for rotation about said longitudinal axis and for limited pivotal motion about axes transverse to the longitudinal axis, whereby such pivotal motion can accommodate uneven print facets co-operating with the roller and thereby ensure even ink application.

Such an inking pad assembly ensures that even if the overall alignment of the pad to the operative facets of the print head is incorrect throughout the life of the corresponding printing mechanism the operative print facets at any given time will be evenly inked.

Further according to the present invention there is provided an inking pad assembly comprising an inking pad roller of absorbent material rotatable about its longitudinal axis, a spindle supporting the roller for free rotation with a clearance over the co-operating lengths of the spindle and roller and means operative between the roller and the spindle serving to reduce said clearance and thereby enable limited pivotal motion about axes transverse to said longitudinal axis so that uneven presentation of print facets can be accommodated.

It is important in printing mechanisms that the individual components shall be inexpensive and to keep the cost within reasonable levels the actual assembly operation needs to be simple and require only inexperienced operators. The construction set forth in the immediately preceding paragraph ensures that the desired aim of limited motion about axes transverse to the axis of rotation of the pad is achieved without undue complexity and corresponding cost.

The provision of a clearance over a part of the length of the ink pad assembly and a limited or negligible clearance over another part will effectively limit the amount of pivotal movement about the transverse axes, but this will not always be satisfactory because of the rubbing action between the spindle and the sleeve. The provision of an external flange on a sleeve mounting the roller ensures that the friction will be kept to a reasonable level while at the same time the pad is properly located axially by the same member.

In a further construction, a second flange is releasably mounted on the sleeve, and serves to locate the roller on the sleeve. This second flange once again simplifies the assembly operation thus assisting in keeping the cost within reasonable limits.

In another advantageous construction the limited pivotal motion provided by the reduced clearance is defined by a projection on the spindle co-operating with an internal ring formed in the sleeve and abutting the projection.

This construction again assists in keeping the assembly operation simple, ensuring that inadvertent disassembly will not occur and, bearing in mind that inking roller assemblies of the kind in question are generally made of plastics materials, the problems of moulding are kept to a minimum.

The projection and the ring preferably have opposed abutting surfaces extending transversely to the axis of rotation of the roller, and this construction ensures that the assembly cannot become inadvertently dis-assembled (which is not normally required since the ink pad assembly as a whole is normally a disposable item) and the abutting surfaces also give a precise location of the transverse pivotal axes.

Preferably the projection and the ring each have their faces opposite to the said abutting surfaces, formed as frusto-conical surfaces to assist insertion of the spindle into the sleeve by a snap action. By making the parts of resilient plastics material these frusto-conical surfaces usefully assist the assembly operation.

The spindle preferably carries a knob at one end, the knob having two transverse flanges which serve to locate the spindle in an associated casing wall. This knob is intended to assist ease of insertion of the ink pad assembly into a corresponding printing mechanism, and at the same time inadvertent release of the ink pad assembly is prevented.

Further according to the present invention there is provided an ink pad assembly comprising a cylindrical pad of absorbent material, a sleeve member having a flange at one end and an annular groove at the other end, a flange member, the flange member serving to locate the pad longitudinally of the sleeve after the pad has been threaded on the sleeve to abut said flange, said sleeve having an internal ring mid-way along its length with one face of the ring extending transversely to the axis of the sleeve and another face of frusto-conical form, and a spindle having an annular projection with one face extending transversely to the axis of the sleeve and another face of frusto-conical form, the projection being so disposed that in the assembled condition the transverse faces of the ring and annular projection abut one another and during assembly the frusto-conical surface slide over one another, said spindle also having a knob which has two flanges which serve to lock the spindle in position in one angular location and release it for axial movement in another angular location, said spindle having a clearance with respect to the sleeve apart from the mid-way location of said ring and projection so that the pad and sleeve can make limited pivotal motion about axes normal to the axis of rotation of the roller whereby even inking is provided for associated print facets irrespective of uneven presentation of such facets to the inking roller.

An embodiment of an inking pad roller assembly in accordance with the invention will now be described, by way of example, with reference to the accompanying diagrammatic drawing, the sole FIGURE of which shows, to a much enlarged scale, a longitudinal, fragmentary section of a label applicator incorporating the inking roller.

The applicator has side walls 10, 12 and 14, 16, with the latter pair engaging in the former at chamfer surfaces 18, 20. The walls 14, 16 carry an inking roller assembly 22 identical to an inking roller assembly 24 carried by the side walls 10, 12 and it will, therefore, be necessary to describe only the roller assembly 24 shown in full.

The roller assembly 24 includes a spindle 26 integral, in the preferred embodiment, with a knob 28 having a configuration which enables the inking roller assembly to be locked in the applicator. In order fully to understand the construction of the knob, the inking roller assembly 22 has been shown with its knob displaced through 90° in relation to the knob of the roller assembly 24.

Each knob 28 comprises a transverse base portion 30 with two flanges 32 extending at right angles to the longer edges of the portion 30. The flanges 32 have arcuate edges 31 remote from the base portion 30 and terminate slightly short of the outer ends of the portion 30. The outwardly directed faces of the flanges 32 each have a rib 34 which extends inwardly beyond the portion 30 and outwardly to a respective one of two part-circular wings 36 which themselves extend at right angles to the respective flange 32. Each wing 36 is of segmental shape and has on its inwardly directed face a single triangular section pip 38 with the apex of the triangle extending radially in relation to the longitudinal axis of the knob. The pips assist in providing a locking action when the knob has been rotated through 90° to its locked position. Finally, the knob has two further ribs 40 extending inwardly from the inwardly-directed face of the base portion 30 but of a transverse extent substantially less than that of the portion 30. The ribs 34,40 as viewed end-on are inclined to one another at an angle less than 90°. This simplifies manufacture of the mould tool and serves no purpose in the parts themselves.

The knob 32 is integral with its spindle 26 and this has, approximately at its mid-length, an annular projection 42 of slightly larger diameter than that of the spindle. The projection has one face 44 lying in a plane normal to the axis of the spindle and another face 46 of frusto-conical form. The end 48 of the spindle remote from the knob is of frusto-conical shape and the free extremity lies in the plane of the outer surface of the wall 12. The wall has a spigot 50 with a conical surface 52 to facilitate the engagement of the end 48 of the spindle on insertion of the inking roller assembly.

The wall 10 has an aperture which receives the knob easily but by turning the knob through a given angle holds it in engagement by end parts 54, 56 of the base portion 30 with rim portions 58, 60 of the wall. The rim portions are so spaced from one another that slight deformation of the flanges 32 is required to achieve the final location and correspondingly the knob will not accidentally become released from the applicator.

The inking roller assembly is completed by a sleeve 59 with an integral annular flange 61, itself integral with a peripheral flange 62 co-axial with the sleeve. The sleeve carries the inking pad roller 64 of cylindrical form and made of any appropriate ink absorbent material. At the end portion adjacent the knob the sleeve 59 has an annular groove 66 and this receives, with a snap action, a flange member 68 with a peripheral flange 70 similar to flange 62. An internal, chamfered ring 67 is provided within the sleeve. The extremity of the sleeve 59 is chamfered at 72 to assist threading on the cylindrical pad 64 and the flange member 68.

To assemble the inking roller assembly, the roller 64 is threaded on to the sleeve 59 and the flange member 68 snapped into position in its groove 66. The sleeve subassembly thus formed is then engaged on the spindle 26 and moved along until the projection 42 is engaged by the internal, chamfered, ring 67 of the sleeve 59 and plane transverse faces of these parts engage one another and prevent, positively, disassembly of the spindle and the sleeve subassembly.

To insert the inking roller as a whole into an applicator or other printing apparatus, the spent assembly is removed by turning the knob 32 through 90° and grasping the wings of the knob to withdraw the assembly in the direction of the spindle axis. Insertion of the fresh assembly involves the reverse operation and the assembly is locked in position by the turning action of the knob. Turning of the knob may be assisted by inserting a coin at 74.

In use, the inking pad roller 64 can rotate freely with its sleeve 58 on the spindle and can pivot about the projection 42 on the spindle through a limited angle about axes extending transversely to the spindle rotary axis. This pivoting action is effectively controlled by end-plates 80, 82 (broken lines) of a corresponding print head which co-operate with the peripheral flanges 70, 62 Thus, whatever the precise alignment of the print head relative the inking pad, the latter will automatically take up a location relative to the operative print facets which provides even contact over all the facets of the row of operative facets (shown in broken lines at 84).

Thus various degrees of tolerance errors in the manufacture of the apparatus as a whole can be accommodated without any special steps being required for individual samples of the apparatus.

By the provision of an external protective sleeve fully covering the ink pad roller 64, the volatiles in the ink are preserved even during long storage periods and if removal of the sleeve is effected immediately before the new assembly is inserted, the risk of fingers or clothes staining is reduced substantially.

Assembly of the inking pad sub-assembly of the associated apparatus is very simple and requires no special skills or adjustments.

It will be understood that all parts, other than the ink pad itself, will be made of moulded plastics material.

The inking pad assembly hereinbefore described may be used for example in a label applicator in which the print head or heads are guided by cams past the inking rollers.

We claim:

1. An inking pad assembly comprising
an inking pad roller of absorbent material rotatable about its longitudinal axis,
a sleeve mounting the roller,
a spindle supporting the sleeve and roller for free rotation with a clearance over the co-operating lengths of the spindle and the sleeve, and
means operative between the roller and the spindle serving to reduce said clearance and thereby enable limited pivotal motion about axes transverse to said longitudinal axis so that uneven presentation of print facets can be accommodated, said means comprising
a projection on the spindle, and
an internal ring formed within the sleeve and abutting the projection.

2. An assembly according to claim 1 wherein the sleeve has at least a flange at one end arranged to cooperate with a part of apparatus in which the assembly is mounted.

3. An assembly according to claim 2 comprising
a second flange detachably mounted on said sleeve and serving to locate the roller axially on the sleeve.

4. An assembly according to claim 1 wherein the projection on the spindle and the ring within the sleeve have opposed abutting surfaces extending transversely to the axis of rotation of the sleeve and roller.

5. An assembly according to claim 1 wherein the projection on the spindle and the ring within the sleeve each have at their faces opposite to respective said abutting surfaces, frusto-conical surfaces to facilitate insertion of the spindle into the sleeve.

6. An assembly according to claim 1 comprising a knob at one end of the spindle, said knob having two transverse flanges which together serve to locate the spindle in a casing wall of associated apparatus.

7. An assembly according to claim 6, wherein one of said flanges of the knob is generally rectangular and end portions of this flange serve their locating purpose only in one angular orientation of the spindle, but allow release of the spindle for movement along its longitudinal axis in another angular location.

8. An ink pad assembly comprising
a cylindrical pad of absorbent material,
a sleeve member having a flange at one end and an annular groove at the other end,
a flange member, the flange member serving to locate the pad longitudinally of the sleeve after the pad has been threaded on the sleeve to abut said flange,
said sleeve having
an internal ring mid-way along its length with one face of the ring extending transversely to the axis of the sleeve and another face of frusto-conical form,
a spindle having
an annular projection with one face extending transversely to the axis of the sleeve and another face of frusto-conical form,
the projection being so disposed that in the assembled condition the transverse faces of the ring and annular projection abut one another and during assembly the frusto-conical surfaces slide over one another,
said spindle also having
a knob which has
two flanges which serve to lock the spindle in position in one angular location and release it for axial movement in another angular location,
said spindle having a clearance with respect to the sleeve apart from the mid-way location of said ring and projection so that the pad and sleeve can make limited pivotal motion about axes normal to the axis of rotation of the roller whereby even inking is provided for associated print facets irrespective of uneven presentation of such facets to the inking roller.

* * * * *